US012202664B2

(12) United States Patent
Michael et al.

(10) Patent No.: US 12,202,664 B2
(45) Date of Patent: Jan. 21, 2025

(54) BEVERAGE CONTAINER

(71) Applicant: Party Paccs, Inc., Austin, TX (US)

(72) Inventors: Colin Michael, Newport Beach, CA (US); Madison Largey, New York, NY (US); Nathaniel Jiang, Davis, CA (US)

(73) Assignee: Party Paccs, Inc., Austin, TX (US)

( * ) Notice: Subject to any disclaimer, the term of this patent is extended or adjusted under 35 U.S.C. 154(b) by 0 days.

(21) Appl. No.: 18/171,626

(22) Filed: Feb. 20, 2023

(65) Prior Publication Data

US 2023/0264879 A1 Aug. 24, 2023

Related U.S. Application Data

(60) Provisional application No. 63/312,361, filed on Feb. 21, 2022.

(51) Int. Cl.

| | |
|---|---|
| ***B65D 77/28*** | (2006.01) |
| ***B65D 75/00*** | (2006.01) |
| ***B65D 75/58*** | (2006.01) |
| ***B65D 77/30*** | (2006.01) |

(52) U.S. Cl.

CPC ..... *B65D 77/283* (2013.01); *B65D 75/008* (2013.01); *B65D 75/58* (2013.01); *B65D 77/30* (2013.01)

(58) Field of Classification Search

CPC .... B65D 77/283; B65D 77/30; B65D 75/008; B65D 75/58

USPC ..... 383/200

See application file for complete search history.

(56) References Cited

U.S. PATENT DOCUMENTS

| | | | | |
|---|---|---|---|---|
| 2,992,118 | A | 7/1961 | Gordon | |
| 3,074,612 | A | 1/1963 | Schneider | |
| 3,799,914 | A * | 3/1974 | Schmit et al. | B65D 75/008 426/115 |

(Continued)

FOREIGN PATENT DOCUMENTS

| | | | |
|---|---|---|---|
| JP | H1016958 | A | 1/1998 |
| JP | 2022022187 | A | 2/2022 |

(Continued)

OTHER PUBLICATIONS

International Searchign Authority, International Search Report and the Written Opiinion dated Jun. 15, 2023 in International Patent Application No. PCT/US2023/062909 (12 pages).

*Primary Examiner* — Peter N Helvey

(74) *Attorney, Agent, or Firm* — Trop, Pruner & Hu, P.C.

(57) ABSTRACT

A drink container comprising: a pouch with exterior and interior surfaces, the interior surface defining an internal chamber; a straw located entirely within the internal chamber; a seam connected to a border of the pouch, the seam partially separating a first portion of the internal chamber from a second portion of the internal chamber; wherein the straw is fixedly attached to the interior surface at a first location; wherein the pouch includes first and second opposing side panels, the first and second opposing side panels coupled to one another along the border and along the seam; wherein the first side panel includes first and second layers; wherein a first portion of the first side panel includes the first layer but not the second layer; wherein the first portion of the internal chamber includes: (a) the first portion of the first side panel, and (b) a first end of the straw.

20 Claims, 11 Drawing Sheets

(56) References Cited

U.S. PATENT DOCUMENTS 4,411,359 A * 10/1983 Franco ..... B65D 77/283 206/217
4,806,021 A * 2/1989 Koudstaal ..... B65D 77/28 206/217
5,884,758 A 3/1999 Sigouin et al.
5,941,642 A * 8/1999 Darmstadter ..... B65D 77/283 383/207
6,220,756 B1 * 4/2001 Darmstadter ..... B65D 75/5811 383/207
6,334,711 B1 * 1/2002 Risgalla ..... B65D 75/30 426/123
6,375,001 B1 4/2002 Beach
6,375,002 B2 4/2002 Edwards
6,481,889 B2 * 11/2002 Delsahut ..... B65D 81/03 383/44
6,550,226 B1 * 4/2003 Gates ..... B65B 43/36 53/469
6,652,144 B2 * 11/2003 Stefandl ..... B65D 77/283 383/200
D485,748 S * 1/2004 Murray ..... D9/707
6,854,490 B2 * 2/2005 Murray ..... B65D 75/58 206/217
6,912,825 B2 * 7/2005 Kothari ..... B65D 77/283 206/217
7,005,150 B2 * 2/2006 Kuge ..... B65D 77/283 426/123
7,150,734 B2 * 12/2006 Lecointe ..... A61D 19/022 604/416
D558,595 S 1/2008 Berman
D588,015 S 3/2009 Berman
8,523,440 B2 9/2013 Walker et al.
11,548,712 B2 * 1/2023 Nash ..... B65D 75/008
2012/0301055 A1 11/2012 Ackerman et al.

FOREIGN PATENT DOCUMENTS

KR 1020030020688 A 3/2003
KR 20110008018 U 1/2011
KR 1020150095179 A 8/2015
KR 101622581 B1 5/2016
KR 102152221 B1 9/2020
WO 2000059802 A1 10/2000
WO 2018104692 A1 6/2018

* cited by examiner

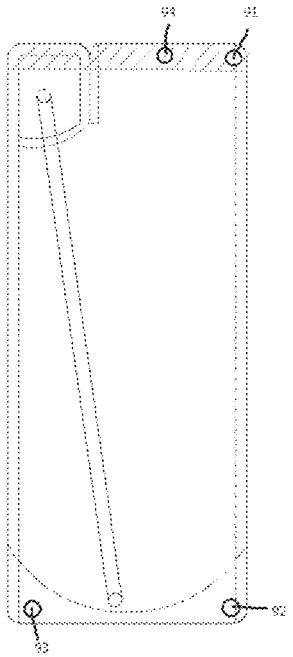
Fig. 9
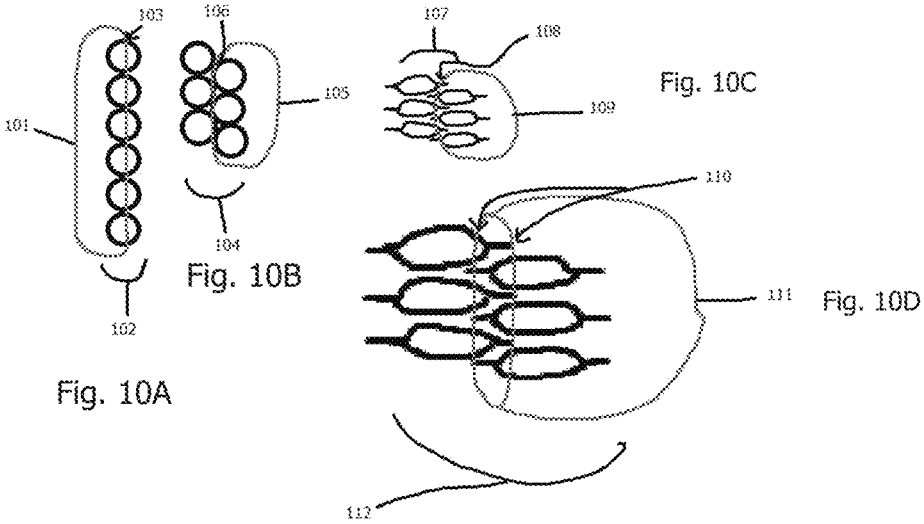
Fig. 10A
Fig. 10B
Fig. 10C
Fig. 10D

BEVERAGE CONTAINER

CROSS-REFERENCE TO RELATED APPLICATION

This application claims priority to U.S. Provisional Patent Application No. 63/312,361 filed on Feb. 21, 2022 and entitled "Beverage Container", the content of which is hereby incorporated by reference.

BACKGROUND

Drinking containers may include bottles, cans, pouches, and the like.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

FIG. 9 includes a sideview of an embodiment of the invention.

FIGS. 10A, 10B, 10C, 10D include sideview of an embodiment of the invention.

DETAILED DESCRIPTION

Figure 1:
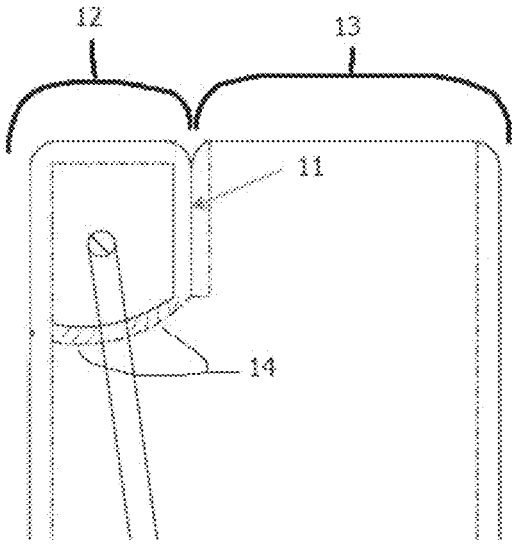
FIG. 1 includes a partial sideview of an embodiment of the invention.

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photo, may appear different while still incorporating the claimed structures of the illustrated embodiments (e.g., walls may not be exactly orthogonal to one another in actual fabricated devices). Moreover, the drawings may only show the structures useful to understand the illustrated embodiments. Additional structures known in the art may not have been included to maintain the clarity of the drawings. For example, not every layer of a device is necessarily shown.

"An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A or B" include situations with A, B, or A and B.

An embodiment includes a container, for example, a multi-layered plastic pouch with a straw sealed inside that a user can reveal by having the straw puncture through the outside layer allowing someone to drink from it.

An embodiment includes a container for holding liquid (a pouch), including a straw for drinking. The straw is fully contained inside the pouch until the user punctures the straw from the inside of the pouch to the outside for drinking. The straw is heat-sealed to the inside of the pouch, so it is immobile both axially and laterally. An area is puncturable (through perforation or less plastic layers or weaker layers without aluminum support) in the pouch that is shaped and positioned such that the top of the straw can pierce through it when the user maneuvers a fold in the pouch. When the straw has punctured the designated area of the pouch, just a top portion of the straw is exposed so the user can drink out of the straw. The straw thickness and size are optimized for drinking experience and puncturing function. The puncture area is a vertically aligned oval whose shape and position were optimized for easier puncturing and straw exposure. The size of the area for puncturing is minimized/optimized so that the strength of the container surrounding the area for a picture is maintained during transit or while not in use.

Following are a list of problems identified by Applicant as well as embodiments that provide solutions to those identified problems.

Problem 1: In typical drinking pouches, the straw is given to the user by attaching it to the outside of the pouch. In order to attach a straw to the outside of the pouch, a straw is typically packaged in a thin plastic sleeve and glued to the outside of the pouch or provided in some sort of secondary packaging.

However, such a system has shortcomings, a few of which are addressed as follows. The system necessitates extra plastic/packaging to hold the straw before use. The straw will sometimes become separated from the pouch before use, making it difficult to drink the contents of the pouch. The straw will sometimes get damaged before use, making it difficult to drink out of the pouch. The straw can be separated from the pouch after its use and during the waste disposal process. Straws that are separated can then be easily misplaced in the waste disposal process and end up in undesirable locations (such as the ocean) rather than the intended location (the landfill). The process to use the straw to drink out of the pouch requires a user first to remove the straw from its packaging and then insert the straw into the pouch. These steps introduce an opportunity for the user to damage the straw, making it difficult to drink out of the pouch. Further, the process to use the straw for drinking out of the pouch requires the user to touch the straw (the portion that is going to touch their mouth) with their hands, which can cause a problem with sanitation. The insertion process of the external straw can sometimes cause the user to pierce both sides of the pouch, creating an undesired hole in the pouch that allows liquid to leak.

Solution 1: An embodiment seals the straw to the inside of the pouch instead of to the outside of the pouch. In the embodiment this is achieved by using heat and pressure (heat sealing) to attach the inside wall of the pouch to the wall of the straw. The straw is heat-sealed to the pouch at a point just below the puncture area. This allows for physical manipulation of the lower end of the straw. The lower half of the straw can rotate about the heat seal point. This pivot capability allows the user to manipulate the straw to reach more of the pouch, which is important when the liquid inside is nearly depleted.

The embodiment has several advantages. The straw cannot be easily separated from the pouch before, during, and after use. This allows for consistent and reliable placement of the straw and no additional packaging. This method of sealing the straw within the pouch also allows for one less step from receiving the pouch to drinking the pouch. A CapriSun®-style pouch requires the user first to open the straw packaging and then puncture the straw into the pouch, but the embodiment removes a step and only requires the user to puncture the straw through the pouch.

Problem 1a: Need a method to reveal the straw inside the pouch for drinking.

Solution 1a: An embodiment includes a method for revealing the straw. The method includes the user manipulating or folding a portion of the pouch (located in one of the top corners) to align a small puncturing area with the tip of the straw and force the tip of the straw to pierce the puncturing area.

For example, in FIG. 1 area 12 (i.e., area that the user manipulates) is separated from the rest of the pouch 13 by seam 11, making opening the pouch easier. This separation also makes it clear to the user the method to open. There is a heat-sealed area 14 around the straw, which helps to eliminate unwanted sloshing of liquid out of the opening around the straw. Since the straw is sealed in place and cannot move axially, once the straw is revealed through the puncture area, the user cannot pull up on the straw to create more drinking distance (i.e., reveal more of the straw outside of the pouch). The pouch can be scrunched down/folded down around the straw all the way to the point of the heat seal 14. This allows the user to choose how much straw is revealed outside of the pouch. This movement is enabled by the folding area 12 of the pouch that is separated from the rest of the pouch 13 by separable seam 11. Additionally, the embodiment includes aluminum (or other metal) and polypropylene (or other polymer) which allow the folded pouch area to mostly maintain its scrunched/folded back position. Further, the puncturing area comprises 1-2 fewer layers of the film structure that make up the pouch, thus leaving a small weaker area that the straw can puncture. The size of the puncturing area is minimized to not compromise the structural integrity of the pouch or risk accidental punctures by the straw or other objects. The size of the puncture area may be increased by elongating the oval. This elongation makes it easier to scrunch or reduce area 12 down around the straw, so a longer portion of the straw can be revealed for drinking. In one embodiment, the shape for this puncturing is an oval since an oval is a cross-section of a straw (cylinder) at an angle between 0 and 90 degrees.

The location of the puncture area provides an advantage as well. In an embodiment, the puncture zone is prioritized to be closer to the outside of the packaging. The further it is from the fill area 13, the more area someone has to place their mouth on the straw without touching 13.

If the straw is to be heat sealed to the inside of the pouch, the straw may be formed thick enough to withstand the heat-sealing process. Such a thickness may be critical in some embodiments. In an embodiment the need for a thick straw for heat sealing is balanced with the need for a comfortable straw for the user to drink out of. The straw is thick/strong enough to puncture through the appropriate area of the pouch. The straw thickness may be 0.75 mm in some embodiments. However, in other embodiments the start thickness is less thick (less than 0.4 mm, which is the thickness of a typical drinking straw). The embodiment may include a thickness of 0.75 mm to prevent the straw from collapsing during the heat-sealing process and to provide enough rigidity to pierce the film. This thickness will depend on the straw composition, and in some embodiments viable compositions need to be able to withstand the heat and pressure of joining it to the interior wall and manipulation of the straw. In an embodiment, the straw is made of polyethylene. In order to avoid a plastic taste, the heat and pressure during heat sealing are minimized and only enough heat and pressure are used to confirm the straw is secure in place.

Figure 2:
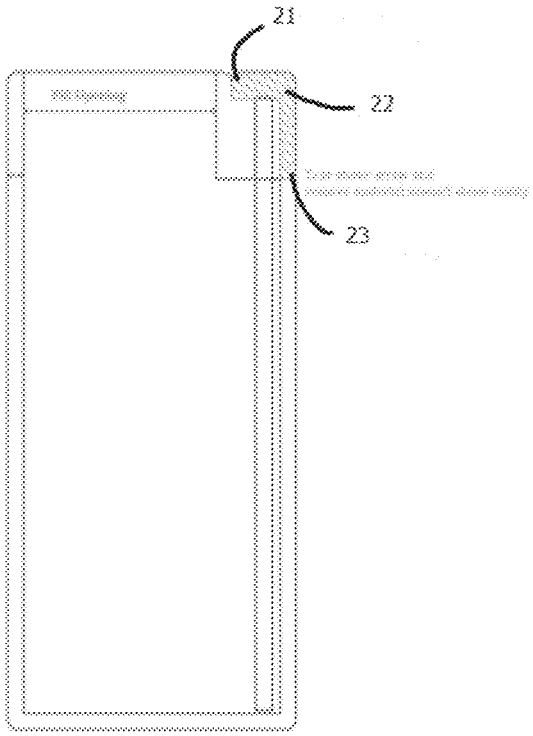
FIG. 2 includes a sideview of an embodiment of the invention.

Solution 1b: FIG. 2 addresses a method of revealing the straw that includes the user ripping off a top corner 22 of the pouch to reveal the straw. This avoids the need for any puncture area and could be easier for the user. Places 21 and 23 are both suitable starting points for small pre-cuts to start the tear.

Figure 3A:
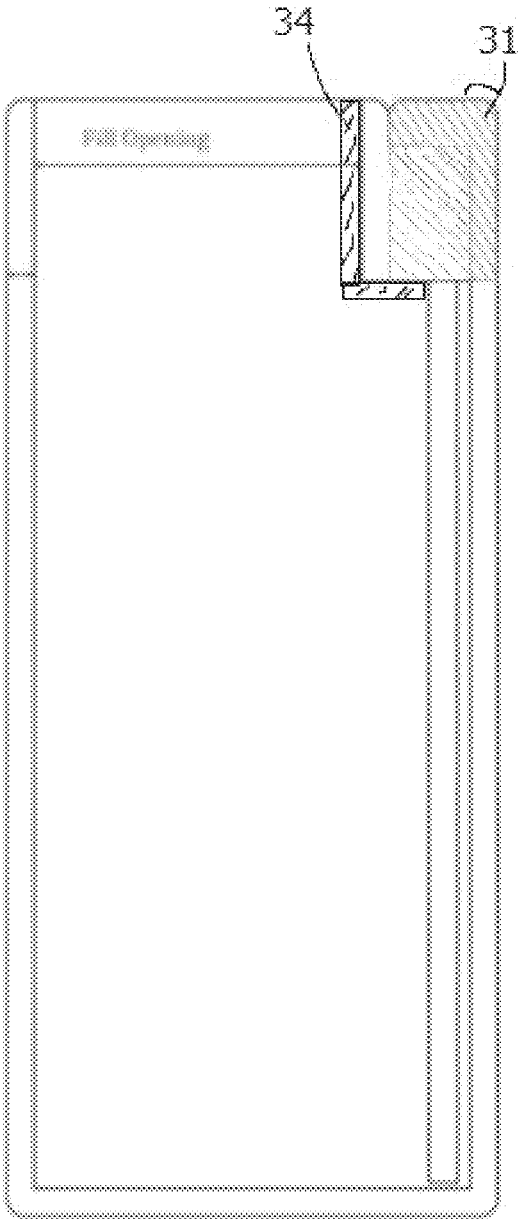
FIGS. 3A, 3B, 3C include sideview of an embodiment of the invention.
Figure 3B:
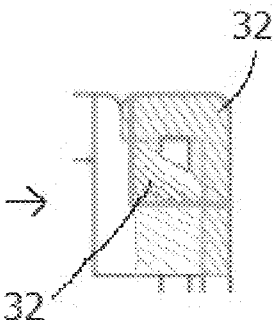
Figure 3C:
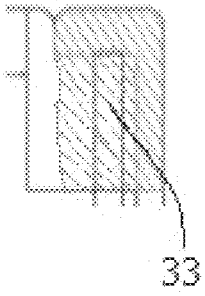

Solution 1c: FIGS. 3A, 3B, 3C address a method of revealing the straw that includes the user peeling open a top corner 31 of the pouch to reveal the straw. This avoids the need for any puncture area and could be easier for the user. Location 32 depicts the reveal of the straw of the partially peeled open area. Section 33 shows the positioning of the straw under an unpeeled open corner. The peel would continue until it hits the heat-sealed corner 34 to not allow the consumer to over open the pouch.

Advantages to solutions 1b & 1c: Since revealing the straw on these two embodiments does not require a puncture site, the pouch can sustain more pressure prior to bursting.

Solution 2 (to solve problem 1): Instead of heat sealing the straw to the inside wall of the pouch, the pouch can be heat sealed to itself in certain places in order to trap the straw in place.

Figures 4A, 4B, 4C:
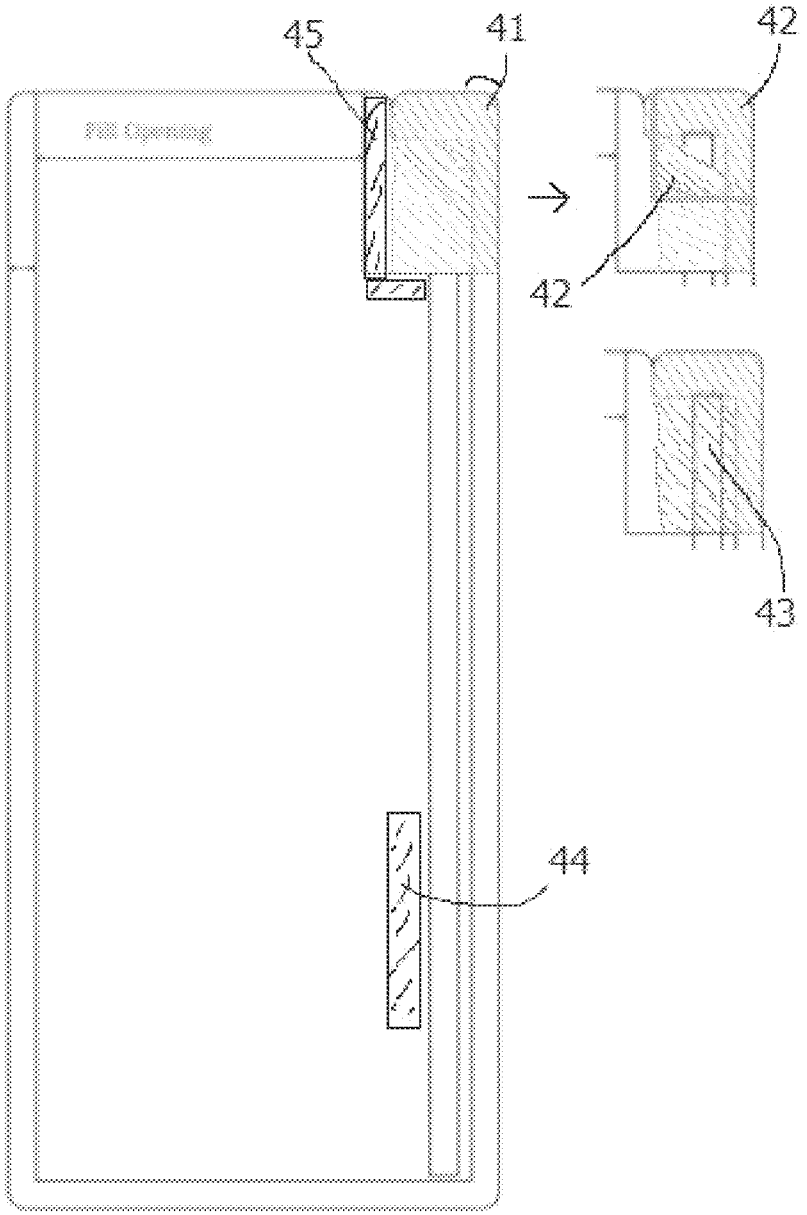
FIGS. 4A, 4B, 4C include sideview of an embodiment of the invention.

This is advantageous because it does not require a relatively thicker straw and allows the user to freely adjust the height of the straw for optimal mouth distance from the pouch when drinking. As shown in FIG. 4A, 4B, 4C, this can be accomplished by keeping the top corner 41 sealed off (see heat seal area 45) and extending a heat seal parallel to the vertical edges of the pouch (see heat seal area 44 in the figure below). These heat seals trap the straw against the wall. The size of the heat seal in area 44 may be minimized such that it impacts the overall volume of liquid the pouch as little as possible while still holding the straw in place. Any additional heat sealing of the walls to each other may further limit the pouches' ability to expand when filled. The heat seals (such as heat seal 44) may be positioned such that the user cannot move the straw outside the designated straw area between the wall of the pouch and the heat seals. Location 42 depicts the reveal of the straw of the partially peeled open area. Section 43 shows the positioning of the straw under an unpeeled open corner. The peel would continue until it hits the heat-sealed corner 45 to not allow the consumer to over open the pouch.

Problem 2 (applied to embodiments described above): A sealing bar may be used to seal the top of the pouch during manufacturing. If the straw reaches the top of the pouch (where the seal bar interacts with the pouch), it could seal the straw closed; therefore, the straw may be positioned lower in the pouch. Overall, Applicant determined this presents a problem in that one or more of the above embodiments might not allow enough straw to be exposed for comfortable drinking.

In embodiments, the seal is placed/secured below the seal bar line. This may present some difficulties when the straw is heat-sealed in place such that the straw cannot move axially because a user may want the straw to be close to the top of the pouch so the user can easily drink out of it and so that the user can place their lips on the straw without coming into contact with the walls of the pouch.

Solution 3 (to solve problem 2): Do not heat seal the straw to the pouch wall. Instead, secure the straw in the pouch using the method described in solution 2.

Figure 5:
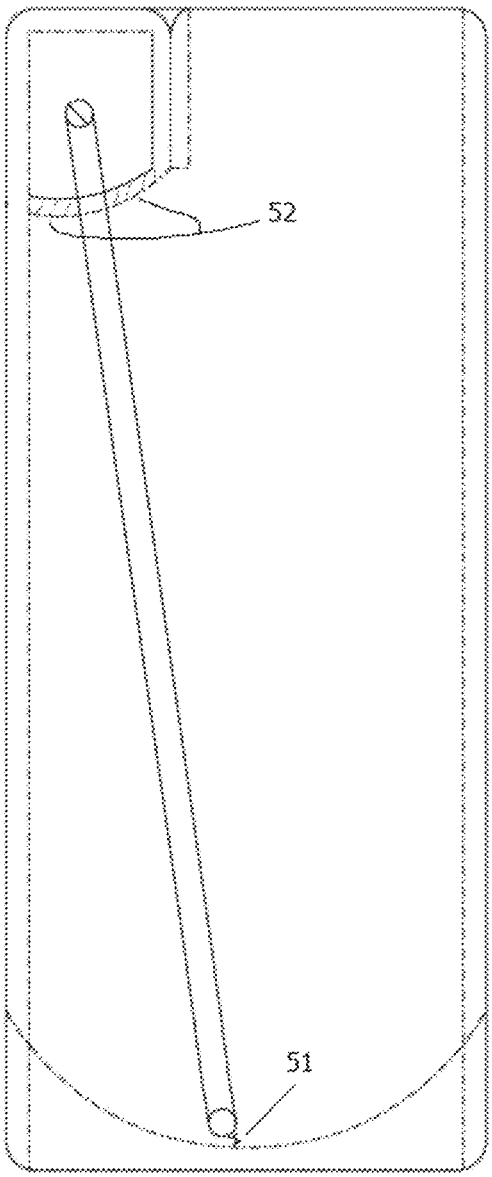
FIG. 5 includes a sideview of an embodiment of the invention.

In order to prevent the straw from falling/getting lost inside the pouch so that it is unable to be used for drinking, the straw may be made as long as possible so that it takes up most of the height of the pouch. The straw may extend from the top corner marked off by heat seal 52 in FIG. 5 to the bottom center of the curve that forms the bottom gusset. The distance from the bottom of the straw to the bottom of the gusset (51) may be minimized. This will allow the user to drink as much as possible in an upright position as well as help the straw stay in one position because it is too long to easily move horizontally in the pouch. The bottom corners of the gusset are closer to the top of the pouch than the center of the gusset, therefore if the straw extends all the way to the center of the gusset, there is a reduced risk of the straw falling horizontally.

Solution 4 (to solve problem 2): Include a telescoping straw that can be extended. This telescoping straw may still be heat sealed in place or held in place by heat seals around the straw. This allows the user to create a preferred distance from the top of the straw to the body of the pouch.

Solution 5 (to solve problem 2): A bendy straw that sits below the heat seal line and is folded up inside the pouch.

Figure 6:
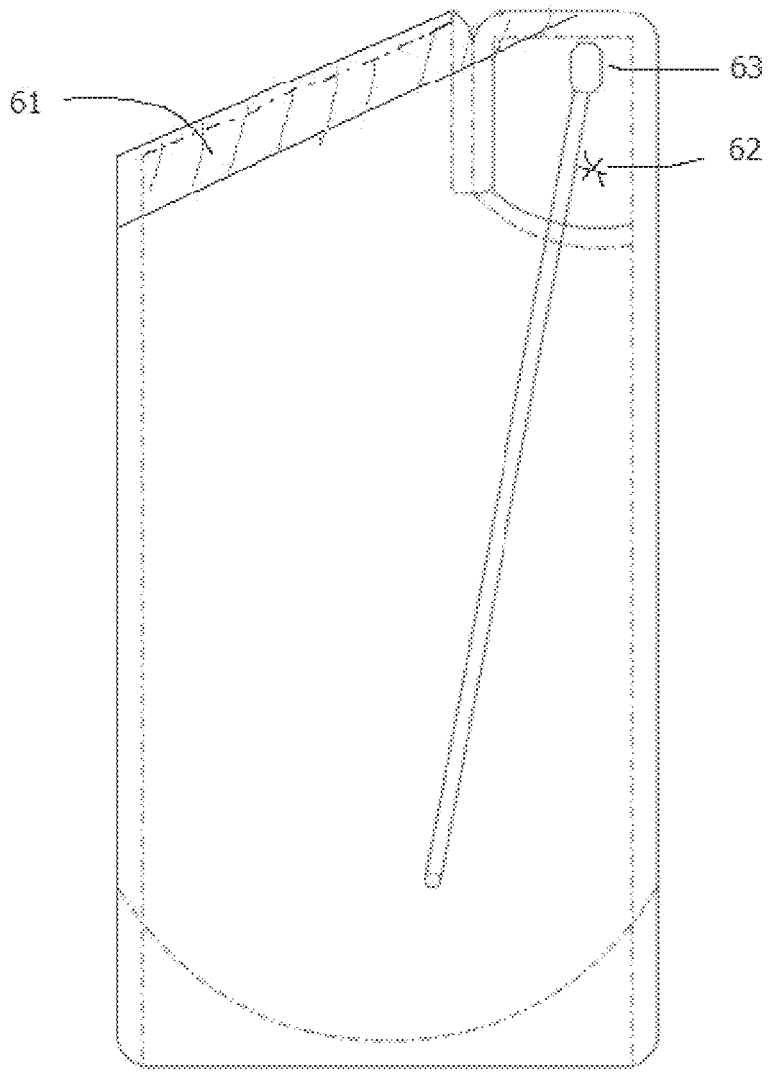
FIG. 6 includes a sideview of an embodiment of the invention.

Solution 6 (to solve problem 2): As shown in FIG. 6, another way to increase the length of the exposed straw is to angle the seal portion (see area 61 below). The seal portion is the area that remains open for filling and is often sealed with a seal bar after filling. When the fill area is angled away like in FIG. 6, the straw length may be increased. Most heat seal bars may then be able to seal straight across area 61 without the worry of hitting the straw in its raised position 63. This new location 63 for the top of the straw and puncture area is superior to 62 (the location of the puncture area in the embodiments in which the seal area is not angled) because this allows for the straw to be longer, meaning more will be exposed when opened and surrounding material pushed down.

Problem 3: An embodiment is intended for alcoholic beverages. Often, alcoholic beverages need to be poured from their original containers to a glass/alternate container. Containers may lack a way to quickly pour the beverage from the pouch to an alternate container.

Figure 7:
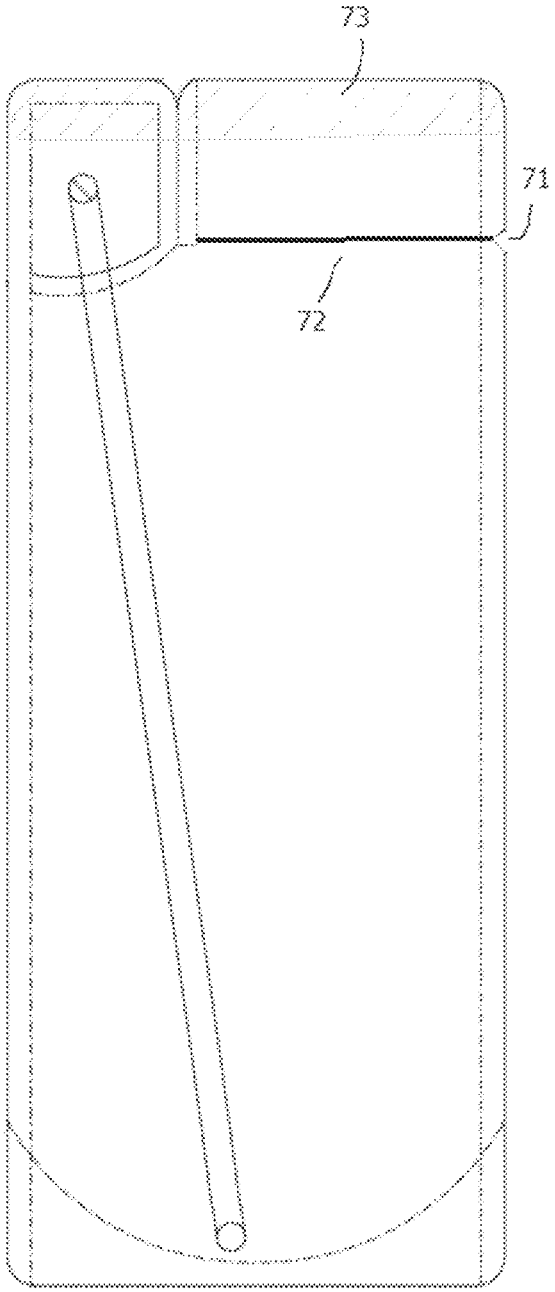
FIG. 7 includes a sideview of an embodiment of the invention.

Solution 6 (to problem 3): As shown in FIG. 7, an embodiment adds a second way of opening the pouch (other than through the straw). This second method includes tearing open a larger portion of the pouch starting from a pre-marked area. This allows someone to drink from or pour from this new opening. As long as the tear mark 71 is made below the sealed area 73, then tearing across width line 72 is possible. The torn-away section is designed to be kept after finishing each drink, regardless of whether that was the method used to open it. This creates a physical reminder to remind the user how many drinks the user had. Alternatively, another embodiment provides the second opening so the user does not completely separate the smaller piece of the pouch from the main body. This stops users from having to hold or manage to dispose of additional pieces of waste. This may be done by only creating a tear start from one side and adding an indication on the graphics of the pouch. Additional reinforcement to stop makes it more difficult to tear the last portion off.

Problem 4: An embodiment is intended for alcoholic beverages. Alcohol products are typically spoiled in sunlight. Translucent containers like glass vary widely in their ability to stop light from penetrating.

Solution 7 (to problem 4): This may apply to all described embodiments. Pouch material may be opaque aside from, in some embodiments, the small clear straw section. Therefore, minimal sunlight can enter the container and the beverage is protected from spoilage.

Problem 5: If the pouch is opaque, the user cannot easily tell how much is left in the pouch.

Figure 8:
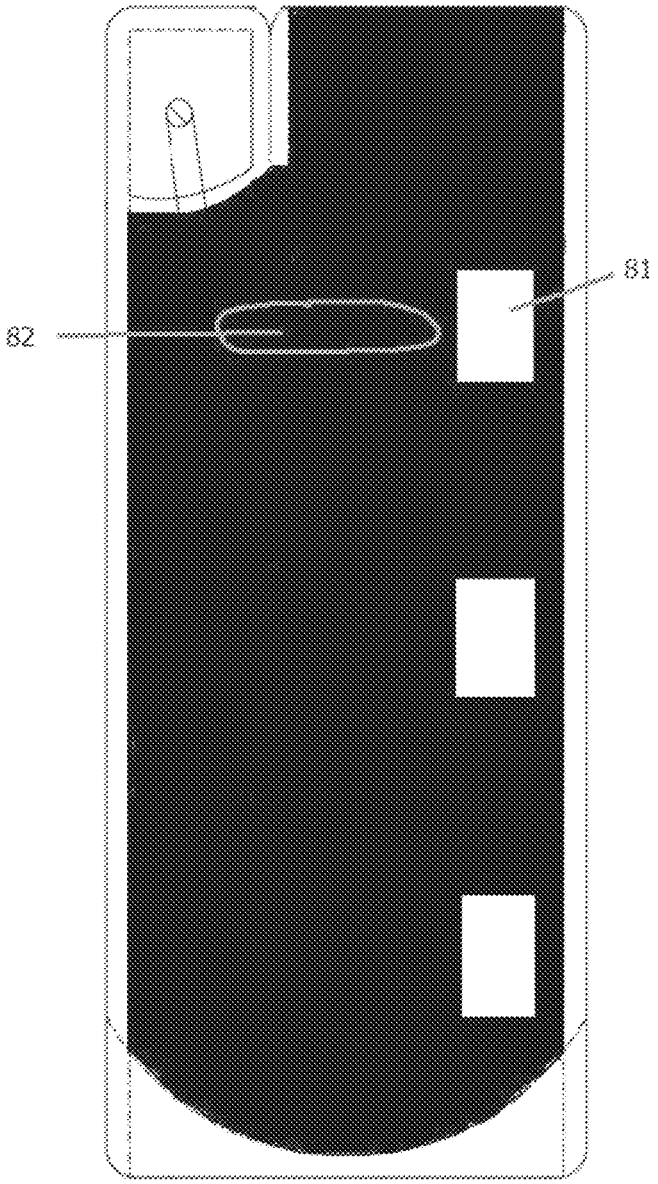
FIG. 8 includes a sideview of an embodiment of the invention.

Solution 8 (to problem 5): As shown in FIG. 8, an embodiment adds additional clear sections 81 to the pouch. These clear sections are small enough (<10% overall outside surface area) so they do not cause concern for sunlight spoilage. The small windows may be at significant points along the vertical axis of the pouch, for example at 75% (see area 81), 50%, 25% the height of the pouch. This allows a user at home or bartender to discern how much is left in the drink. This way a bartender knows when to ask if another one is desired.

The clear windows 81 may also be marked on or next to in area 82 with a permanent marker to help indicate whose beverage is whose or for potential gamification.

Problem 6: Difficult connecting smaller quantities of pouches together without the need for a box. For example, a six-pack of canned beverages (sodas or beers) can be joined together by plastic rings, but conventionally, there is no easy transportation option for small quantities of pouches.

Solution 9 (to solve problem 6): This feature may apply to all described embodiments. As shown in FIG. 9, somewhere along the pouch edges an embodiment would include a hole or combination of holes (see holes 91, 92, 93, 94). These holes allow the pouch to be hooked onto things, such as a carabiner. This allows for individual pouches to be easily transported in settings such as music festivals or other outdoor events.

Like plastic rings to beer cans, a secondary material (e.g., tether or string) may be run through multiple pouches as a way to sell them and facilitate carrying them with one hand. One would hold onto the string in configurations such as strings 101, 105, 109 and 111 in FIGS. 10A, 10B, 10C, 10D. The hole placement closer to the vertical sides of the pouch may allow for a zig-zag style of pouch packing along a string run through the holes 91 or 92 seen in FIG. 9. All views in FIGS. 10A, 10B, 10C, 10D are from the top viewing down on the product. In FIGS. 10A, 10B, 10C, 10D, hole numbers 103, 106, 108, 110 indicate where the holes are and where the string is fed through.

A filled pouch is somewhat similar to the shape of a cylinder. Varying levels of packaging profiles are possible 102, 104, 107, 112. To more efficiently pack cylindrical shapes, one would not line them up center to center (FIG.

10B). One may zig-zag them (FIG. 10D). This zig-zag pattern allows for more efficient space usage on trucks and shelves.

The string may be fed through two holes on the pouch in the zig-zag pattern seen in FIG. 10D, string 111 to mitigate the risk of the pouch ripping about a hole. This works by lining up alternating forward and backward facing pouches and lining up the holes. As seen in FIG. 9, a string may go through hole 94 then into hole 91 on the pouch behind it. The same string or a new string may be fed through hole 91 into hole 94 on the pouch behind it (based on the hole placement in FIG. 9). This may then look like FIG. 10D.

Problem 7/Solution 10: There are regulations surrounding headspace in alcoholic beverage containers. Current regulations for alcohol products often have specific headspace limits/requirements. For example, for a wine product over 187 ml, there cannot be a headspace greater than 7% of the total volume.

Consumers might freeze products before consuming them. If they were to freeze the liquids, the drink may expand between 5-10% larger than its starting volume depending on ambient conditions and ingredients. If this were a rigid container like a can, following the headspace limit might run into the issue of the container bursting or being compromised by the expanding liquid. With an embodiment, the embodiment can be filled up with less than 7% headspace but have an additional 5-15% room to expand. The additional space is not counted as headspace because nothing is currently occupying it. For example, a user may take a large gallon bag but only fill it with a quart of water-sucking all the air out of it before sealing. There may theoretically be no headspace, but the liquid still has room to expand when frozen. In some embodiments, it may be important to keep this headspace ratio to provide additional room in the appropriate tolerances when changing the pouch volume.

Figure 11:
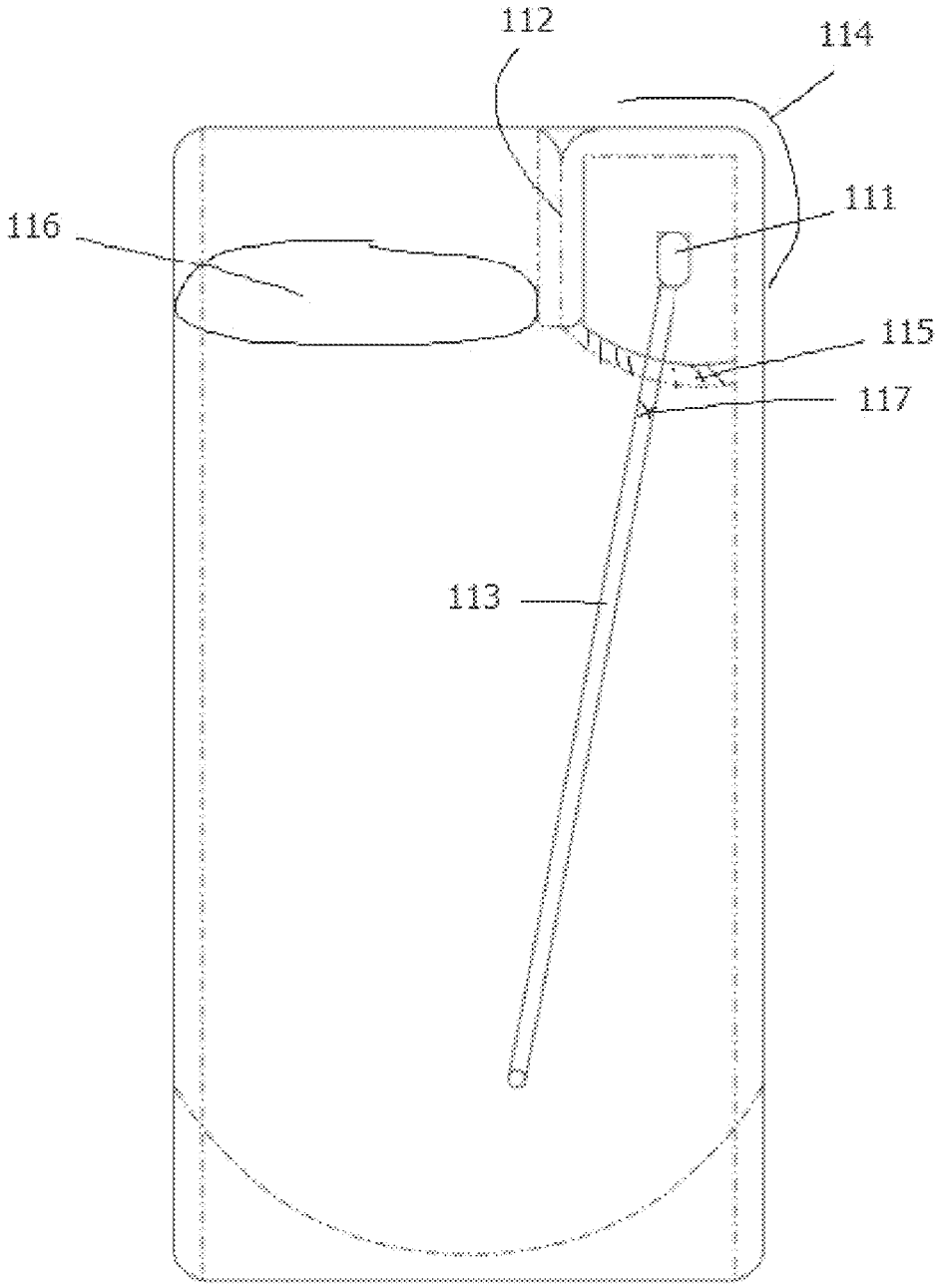
FIG. 11 includes a sideview of an embodiment of the invention.

An additional embodiment is as follows in FIG. 11.

Oval pouch area 111 is pierced by the straw. A scoring or perforation 112 allows the separation of the pouch section that may be manipulated to reveal inside straw 113 from the rest of the top section of the pouch/fill zone 117. Straw 113 is included in area 114 such that a user manipulates area 114 to push the straw through the thin layer of the pouch. Heat seal 115 serves to limit sloshing of liquid to come out of the area around the straw, holds the straw in place for heat sealing, and serves as a backup to hold the straw in the correct orientation if the heat seal were to fail. Area 116 is below seal zone that is flat when filled, but can expand to prevent bursting or pouch failure elsewhere given changes to ambient conditions like freezing a beverage. Area 117 is the point where the wall of the pouch is heat-sealed to the straw.

Embodiments provide an economically viable way to transport and store liquids. Additionally, people enjoy the experience of drinking out of the pouch.

In an embodiment preferred materials are multi-layer plastic with an aluminum layer. The puncture site consists of the same film structure minus the aluminum structural layer. Other embodiments may include PET12/AL6/NY15/LLDPE80 or PET12/AL7/PE80. Embodiments include more environmentally friendly layers or thinner existing layers.

Embodiments may be used as a container for beverages, specifically alcoholic beverages, that may or may not be frozen. Embodiments are advantageous as a container for alcoholic beverages because such embodiments make tampering with the drink much harder than a container such as a non-lidded cup. Alternate uses include any non-alcoholic beverage or liquid or foodstuff that is consumed out of a straw.

Embodiments provide various advantages such as, for example, (1) a straw puncture method that is more consistent due to the straw being sealed in place, (2) a straw puncture method with a pouch that is easier to manipulate due to a pre-cut separating the puncture region and straw tip from the fill area, (3) straw puncture method does not require one to touch the straw, which is more sanitary, (4) straw puncture method with relatively fewer steps than conventional systems, (5) heat sealing around the straw to mitigate some sloshing as well as serve as a potential backup to hold the straw in position, (6) clear windows for explicit indication of the amount of liquid inside, (7) angling the seal/fill area away from the straw, (8) construction of pouch dimension in a ratio optimized to minimize plastic while leaving enough material to be frozen like for alcoholic beverages, (conventional pouches need extra space for frozen liquid expansion), (8) holes punched into excess material on pouch edges to allow for display and for tying a string or other material to hold several units together, (9) holes punched along edges to allow a zig-zag or more robust and space efficient packing method to other pouches, (10) or combinations thereof.

An embodiment uses a heat seal between the straw and the pouch to keep the straw in place within the pouch. The straw of the embodiment cannot move axially. The straw of the embodiment can pivot below the point of the heat seal such that the straw could sit diagonally in the pouch so the user can access the entire contents of the pouch, which is important as the drink becomes close to empty. An embodiment intends for the user to pull on the pouch to meet the straw (because the straw is held in place by the heat seal) rather than the straw being moved. The embodiment may not be opened as described in conventional systems because the straw cannot be moved axially, and the conventional systems cannot be opened as intended in the current invention because the straw would not be held in place axially as the pouch is manipulated to meet the straw. An embodiment includes a fold tab that is meant to be manipulated by the user to meet the tip of the straw for puncturing. An embodiment includes a heat seal that is not only parallel to side edges but also top and bottom. As a result, the embodiment is more sanitary because a user does not need to have direct contact with the straw portion to open/use. The embodiment's utility hole design allows multiple pouches to be strung together for efficient storage and handling. The embodiment can also be used for hanging in retail situations and for attaching to carabiners on backpacks. The embodiment is less likely to have liquid slosh out from the opening made by the straw due to heat sealing that stops all liquid flow between the main chamber and the top of the straw section (besides the liquid through the straw). Further, the embodiment is easier to open than conventional systems as the user does not have to try to grasp and move straw surrounded by liquid and encased in plastic. Instead, the user simply folds down a tab on the pouch to access the straw. The embodiment has the ability for the bottom of the straw to be moved around within the pouch. This enables the user to get the liquid at the very bottom of the pouch out. Further, the straw is less likely to be separated from the pouch because it is heat-sealed in.

An embodiment contrasts with conventional systems in that it is more sanitary because a user does not need to have direct contact with the straw portion to open/use. The embodiment's utility hole design allows multiple pouches to be strung together for efficient storage and handling. It can also be used for hanging in retail situations and for attaching to carabiners on backpacks. The embodiment is less likely to have liquid slosh out from the opening made by the straw due to heat sealing that stops all liquid flow between the main chamber and the top of the straw section (besides the liquid through the straw). The embodiment is easier to open and the user does not have to try to grasp and move straw surrounded by liquid and encased in plastic. Instead, the user simply folds down a tab on the pouch to access the straw. Further, the embodiment includes the ability for the bottom of the straw to be moved around within the pouch. This enables the user to get the liquid at the very bottom of the pouch out. Also, with the embodiment the straw is less likely to be separated from the pouch because it is heat-sealed in. This results in several advantages. In most use cases, the embodiment does not create multiple pieces that need to be disposed of. This again prevents the straw or smaller portions of the pouch from ending up in unwanted locations. The embodiment has less surface area that is not holding liquid and therefore uses less plastic to achieve the same volume of liquid held. The embodiment does not need a bendy straw, is more expensive to manufacture, and uses more plastic. The embodiment is more sanitary than conventional systems because a user does not need to have direct contact with the straw portion to open/use. The embodiment requires fewer motions/steps to reveal straw/be ready for consumption. The embodiment's utility hole design allows multiple pouches to be strung together for efficient storage and handling. It can also be used for hanging retail situations and for attaching to carabiners on backpacks. The embodiment creates a better user experience for drinking out of a pouch and more applications like fluids that need to be frozen. The embodiment does not create multiple pieces of trash. The embodiment's hole design allows for broader uses in addition to those in this prior art. The embodiment's holes are located to allow for efficient zigzag packing.

An embodiment includes a pouch with internal straw that is not free-floating and includes a specific area to manipulate the straw tip through the outside. With a designated puncture area, there is a specific weakened area that allows for easier puncturing. The embodiment includes a mechanism for keeping the straw in place in the pouch and to enable easy opening based on the heat seal and a perforation. As a result, the embodiment is more intuitive on how to open. Further, the straw does not fall out in comparison with conventional systems and one will lose the straw inside. Further, the embodiment is more sanitary because a user does not need to have direct contact with the straw portion to open/use. The embodiment requires fewer motions/steps to reveal straw/be ready for consumption. Also, the embodiment's utility hole design allows multiple pouches to be strung together for efficient storage and handling. It can also be used for hanging in retail or storage situations and for attaching to carabiners on backpacks.

An embodiment includes a pouch with internal straw that is not free-floating. The embodiment includes a marked specific puncture area on the outside of the pouch. The area is weakened for easier puncturing. The embodiment includes a mechanism for keeping the straw in place in the pouch to enable easy opening. Part of this is the heat seal. The other contributing factor is the perforation allowing for easier manipulation. The embodiment does not require the user to find the straw so one cannot lose the straw inside and the straw cannot fall out. The top corner is sealed around the straw and mitigates sloshing from movement or gripping the pouch too tightly. The embodiment is more sanitary because a user does not need to have direct contact with the straw portion to open/use. The embodiment requires fewer motions/steps to reveal straw/be ready for consumption. The embodiment's utility hole design allows multiple pouches to be strung together for efficient storage and handling. It can also be used for hanging and for attaching to carabiners on backpacks An embodiment avoids having to tear something off to reveal a straw. The embodiment includes a mechanism for keeping the straw in place in the pouch to enable easy opening. The embodiment's utility hole design allows multiple pouches to be strung together for efficient storage and handling. It can also be used for hanging and for attaching to carabiners on backpacks. The embodiment's straw is sealed in position and does not require (in order to reveal the straw) tearing around the straw, which is a more difficult and inconsistent method of opening. Further, the embodiment's opening method does not create a second piece of material that could be improperly disposed of.

An embodiment includes a pouch with internal straw that is not free-floating. The embodiment may include a heat seal that holds the straw in the top corner (but does not go all the way around the straw). As a result, the embodiment includes a mechanism for keeping the straw in place in the pouch to enable easy opening and the straw does not become separated from the pouch during or after use. Further, the liquid is less likely to slosh up and around the straw when opened because the embodiment leaves little area around the straw by using more heat seals than conventional systems. Further, the embodiment does not create two/three pieces of material after being opened. The embodiment does not have a tear section and therefore removes the risk of a user tearing too far or inconsistently with each new pouch. The embodiment is more sanitary because a user does not need to have direct contact with the straw portion to open/use. Further, the embodiment requires fewer motions/steps to reveal straw/be ready for consumption. The embodiment utility hole design allows multiple pouches to be strung together for efficient storage and handling. It can also be used for hanging and for attaching to carabiners on backpacks.

An embodiment is different from convention systems that allow for user error (not knowing when to stop tearing or possible tearing, and missing the internal liquid). Further, the embodiment removes some possible user error with the puncture method of opening because there is only one weaker area for it to go through.

Figure 12:
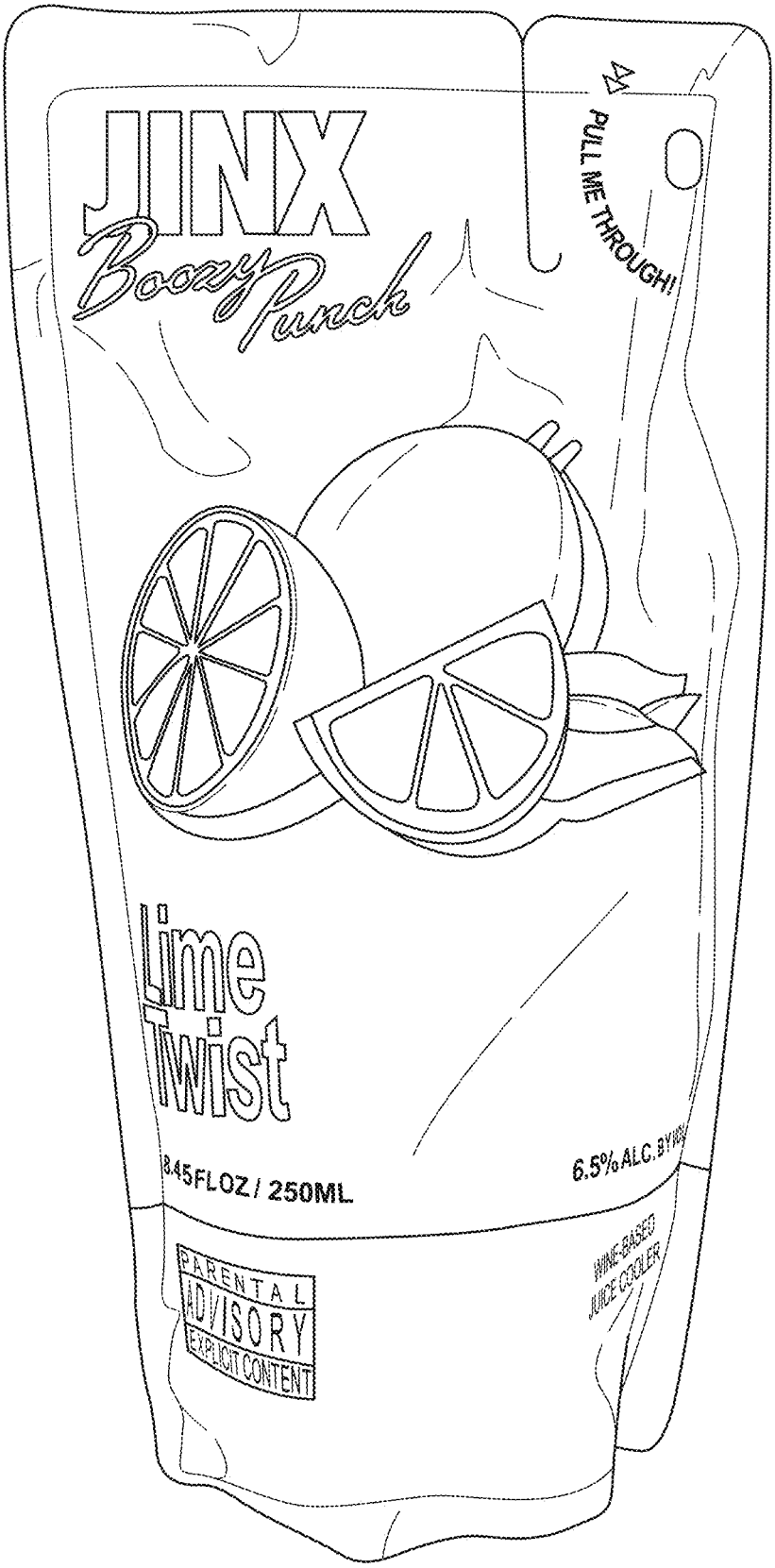
FIG. 12 includes a sideview of an embodiment of the invention.
Figure 13:
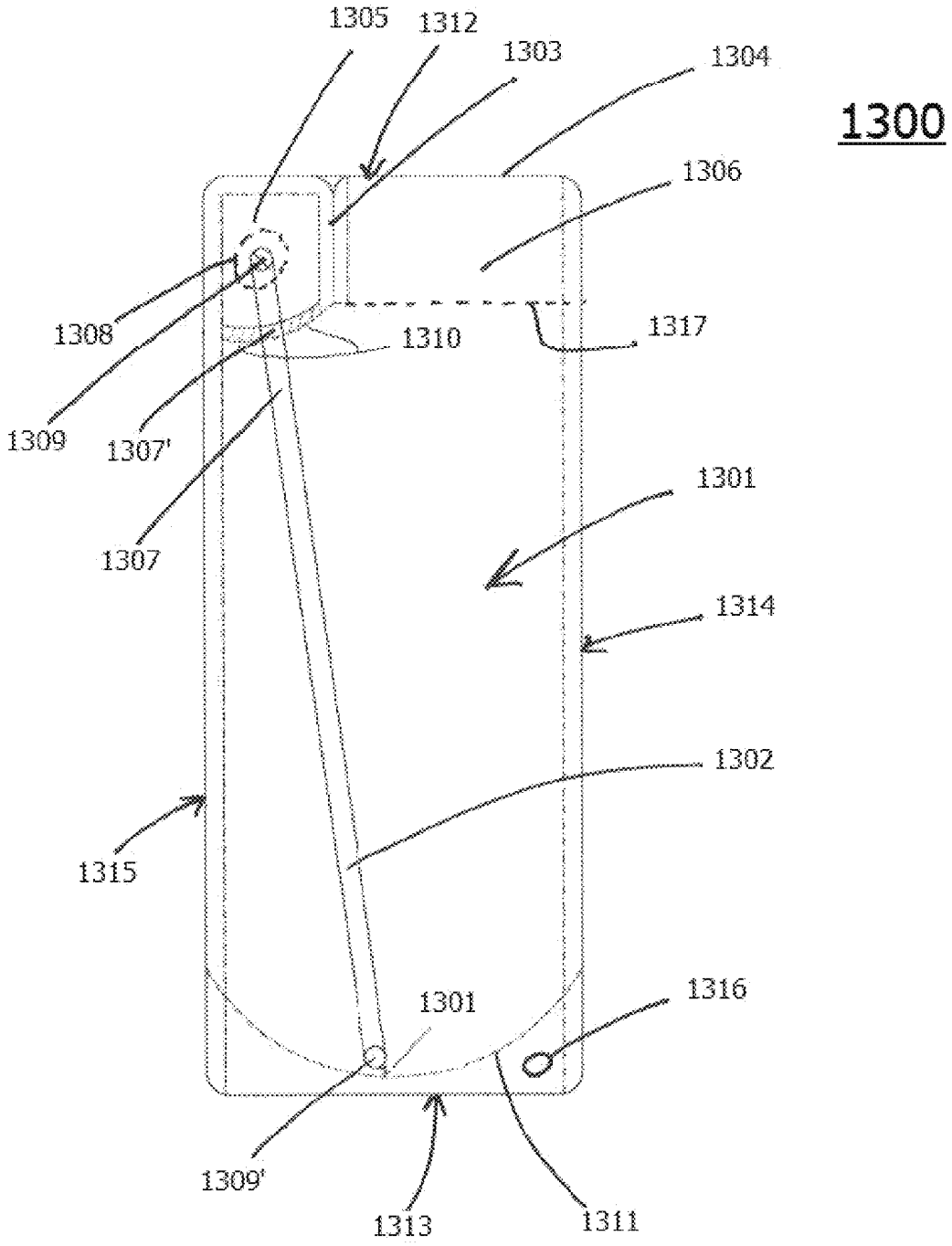
FIG. 13 includes a sideview of an embodiment of the invention.

FIG. 12 includes a side view of an embodiment that includes fluid. The embodiment is seen in more abstract form in FIG. 13. The following examples included references to FIG. 13.

Example 1. A drink container (1300) comprising: a pouch including an exterior surface and an interior surface, the interior surface defining an internal chamber (1301) that is completely sealed off from the exterior surface; a straw (1302) located entirely within the internal chamber; a seam (1303) connected to a border (1304) of the pouch, the seam partially separating a first portion (1305) of the internal chamber from a second portion (1306) of the internal chamber; wherein the straw is fixedly attached to the interior surface at a first location (1307, 1307'); wherein the pouch includes first and second opposing side panels, the first and second opposing side panels coupled to one another along the border and along the seam; wherein the first side panel includes first and second layers; wherein a first portion (1308) of the first side panel includes the first layer but not the second layer; wherein the first portion of the internal chamber includes: (a) the first portion of the first side panel, and (b) a first end (1309) of the straw.

An alternative embodiment may not require that the straw is fixedly attached at the first location or any location. Such an embodiment may merely require a resistance fit for the straw such that the resistance fit can be overcome by the pouch consumer.

Example 2. The drink container of example 1 comprising a seal (1310) that couples to the seam, the seal coupling the first and second opposing side panels to one another.

Example 2.1 The drink container according to any of examples 1 to 2, wherein the first portion of the first side panel is ovular.

Example 3. The drink container of example 2, wherein the straw traverses the seal at a second location (1307').

Example 3.1 The drink container of example 3, wherein the straw is not fixedly attached to the interior surface at the second location.

In an alternative embodiment, the first location may be located at or immediately adjacent the second location such that the straw is heat sealed to the package at the exact location where the straw traverses seal 1310.

Example 4. The drink container according to any of examples 1 to 3, wherein the first portion of the internal chamber is fluidly coupled to the second portion of the internal chamber via the straw.

Example 5. The drink container according to any of examples 1 to 4, wherein the internal chamber includes a fluid.

Example 6. The drink container of example 5, wherein the first portion of the internal chamber includes the fluid and the second portion of the internal chamber includes the fluid.

Example 7. The drink container according to any of examples 2 to 6, wherein the straw is fixedly attached to the interior surface at the first location via a first heat seal.

Example 8. The drink container of example 7, wherein the seal is a second heat seal.

Example 9. The drink container according to any of examples 1 to 8, wherein: the seam includes a middle portion, first side portion, and a second side portion; the middle portion is proportioned to fail while both (a) the first side portion continues to couple the first and second opposing side panels to one another, and (b) the second side portion continues to couple the first and second opposing side panels to one another.

Example 10. The drink container of example 9, wherein the first location is a pivot point of the straw.

Example 11. The drink container of example 10, wherein the second location is not a pivot point of the straw.

Example 12. The drink container of example 11 comprising a pathway for fluid to communicate between the first and second portions of the internal chamber, wherein the pathway is outside the straw and directly adjacent the straw at the second location.

Thus, the seal 1310 is not complete and does not completely seal the first and second portions of the internal chamber from each other. However, the pathway is narrow enough to prevent sloshing of fluid from the second portion of the internal chamber into the first portion of the internal chamber.

Example 13. The drink container according to any of examples 1 to 12, wherein: a second end (1309') of the straw is opposite the first end of the straw; the internal chamber includes a border; the border of the internal chamber includes an arcuate portion (1311); the arcuate portion is immediately adjacent the second end of the straw.

Example 14. The drink container of example 13, wherein: the pouch includes a top wall (1312) that interfaces the seam, a bottom wall (1313) opposite the top wall, a first sidewall (1314) that couples the bottom and top walls to each other, and a second sidewall (1315) that couples the bottom and top walls to each other; the top wall intersects at least one of the first and second sidewalls at a non-orthogonal angle.

See, for example, Solution 6 (to problem 3).

Example 15. The drink container according to any of examples 1-14, wherein: the pouch includes a top wall (1312) that interfaces the seam, a bottom wall (1313) opposite the top wall, a first sidewall (1314) that couples the bottom and top walls to each other, and a second sidewall (1315) that couples the bottom and top walls to each other; at least one of the top wall, the bottom wall, the first sidewall, and the second sidewall includes an aperture (1316) with a contiguous and complete border that defines the aperture and completely encloses the aperture in a plane.

Example 16. The drink container of example 15 comprising an additional pouch, wherein the pouch and the additional pouch are coupled to each other via a tether that traverses the aperture.

Example 16.1 The drink container according to any of examples 1 to 14, wherein the pouch includes an aperture (1316) with a contiguous and complete border that defines the aperture and completely encloses the aperture in a plane.

Example 16.2 The drink container of example 16.1 comprising an additional pouch, wherein the pouch and the additional pouch are coupled to each other via a tether that traverses the aperture.

Example 17. The drink container according to any of examples 1 to 16 comprising a first transparent window in one of the first or second opposing side panels.

Example 18. The drink container according to any of examples 1 to 16 comprising a second transparent window in another of the first or second opposing side panels.

Example 19. The drink container according to any of examples 1 to 16 comprising a second transparent window in the one of the first or second opposing side panels.

Example 20. The drink container of example 19, wherein the second transparent window is closer to the first end of the straw than the first transparent window.

Example 21. The drink container according to any of examples 1 to 20 comprising an additional seam (1317), wherein: the additional seam is connected to the border of the pouch; the additional seam contacts the first and second side panels; the additional seam has a seam tensile strength that is less than a tensile strength of the first side panel; the additional seam is configured, based on the seam tensile strength, to fail and form an opening to the inner chamber; the opening to the inner chamber is larger than an opening at the first end of the straw.

See, for example, Solution 6.

Example 22. The drink container according to any of examples 1 to 20 comprising an additional seam, wherein: the additional seam is connected to the border of the pouch; the additional seam contacts at least one of the first or second side panels; the additional seam has a seam tensile strength that is less than a tensile strength of the first side panel; the additional seam is configured, based on the seam tensile strength, to fail and form an opening to the inner chamber; the opening to the inner chamber is larger than an opening at the first end of the straw.

Example 23. The drink container according to any of examples 1 to 22, wherein the straw includes a wall and the wall thickness is at least 0.75 mm but less than 1.50 mm.

However, in other embodiments the thickness is between 0.55 and 1.0 mm, 0.30 and 0.60, 0.40 and 0.50.

Example 1a. A method comprising: obtaining a drink container, the drink container comprising: (a) a pouch including an exterior surface and an interior surface, the interior surface defining an internal chamber (1301) that is completely sealed off from the exterior surface; (b) a straw (1302) located entirely within the internal chamber; and (c) a seam (1303) connected to a border (1304) of the pouch, the seam partially separating a first portion (1305) of the internal chamber from a second portion (1306) of the internal chamber; wherein the straw is fixedly attached to the interior surface at a first location (1307); wherein the pouch includes first and second opposing side panels, the first and second opposing side panels coupled to one another along the border and along the seam; wherein the first side panel includes first and second layers; wherein a first portion (1308) of the first side panel includes the first layer but not the second layer; wherein the first portion of the internal chamber includes (a) the first portion of the first panel, and (b) a first end (1309) of the straw; the method further comprising: pealing the first portion of the internal chamber away from the second portion of the internal chamber along the seam; in response to pealing the first portion of the internal chamber away from the second portion of the internal chamber along the seam, advancing the straw through the first portion of the first side panel; in response to advancing the straw through the first portion of the first side panel, drinking fluid included within the pouch.

Example 2a. The method of example 1a: wherein: (a) the seam includes a middle portion, first side portion, and a second side portion; wherein the method comprises causing the middle portion to fail while both (b)(i) the first side portion continues to couple the first and second opposing side panels to one another, and (b)(ii) the second side portion continues to couple the first and second opposing side panels to one another.

Example 3a. The method according to any of examples 1a to 2a, wherein: (a) the drink container comprises an additional seam, (b) the additional seam is connected to the border of the pouch; (c) the additional seam contacts at least one of the first or second side panels; (d) the additional seam has a seam tensile strength that is less than a tensile strength of the first side panel; (e) the additional seam is configured, based on the seam tensile strength, to fail and form an opening to the inner chamber; (f) the opening to the inner chamber is larger than an opening at the first end of the straw; wherein the method further comprises: causing the additional seam to fail and forming the opening to the inner chamber; emptying fluid from the pouch via the opening to the inner chamber.

Example 1b. A drink container comprising: a pouch including an exterior surface and an interior surface, the interior surface defining an internal chamber that is completely sealed off from the exterior surface; a straw located entirely within the internal chamber; a seam connected to a border of the pouch, the seam partially separating a first portion of the internal chamber from a second portion of the internal chamber; wherein the straw is fixedly attached to the interior surface at a first location; wherein the pouch includes first and second opposing side panels, the first and second opposing side panels coupled to one another along the border and along the seam; wherein the first side panel includes first and second layers; wherein a first portion of the first side panel includes the first layer but not the second layer; wherein the first portion of the internal chamber includes: (a) the first portion of the first side panel, and (b) a first end of the straw.

Example 2b. The drink container of example 1b comprising a seal that couples to the seam, the seal coupling the first and second opposing side panels to one another.

Example 3b. The drink container according to example 2b, wherein the first portion of the first side panel is ovular.

Example 4b. The drink container according to example 2b, wherein the straw traverses the seal at a second location.

Example 5b. The drink container of example 4b, wherein the straw is not fixedly attached to the interior surface at the second location.

Example 6b. The drink container according to example 2b, wherein the straw traverses the seal at the first location.

Example 7b. The drink container according to example 2b, wherein: the straw is fused to the interior surface at the first location; in response to the straw being fused to the interior surface at the first location, the straw is prohibited from rotation about a long axis of the straw and is further prohibited from translation along the long axis of the straw.

Example 8b. The drink container according to example 7b, wherein the first portion of the internal chamber is fluidly coupled to the second portion of the internal chamber via the straw.

Example 9b. The drink container according to example 8b, wherein the first portion of the internal chamber includes a fluid and the second portion of the internal chamber includes the fluid.

Example 10b. The drink container according to example 2b, wherein the straw is fixedly attached to the interior surface at the first location via a heat seal.

Example 11b. The drink container according to example 2b, wherein: the seam includes a middle portion, first side portion, and a second side portion; the middle portion is proportioned to fail while both (a) the first side portion continues to couple the first and second opposing side panels to one another, and (b) the second side portion continues to couple the first and second opposing side panels to one another.

Example 12b. The drink container according to example 2b, wherein the first location is a pivot point of the straw.

Example 13b. The drink container of example 12b comprising a pathway for fluid to communicate between the first and second portions of the internal chamber, wherein the pathway is outside the straw and directly adjacent the straw at the second location.

Example 14b. The drink container according to example 2b, wherein: a second end of the straw is opposite the first end of the straw; the internal chamber includes a border; the border of the internal chamber includes an arcuate portion; the arcuate portion is immediately adjacent the second end of the straw.

Example 15b. The drink container according to example 2b, wherein: the pouch includes a top wall that interfaces the seam, a bottom wall opposite the top wall, a first sidewall that couples the bottom and top walls to each other, and a second sidewall that couples the bottom and top walls to each other; at least one of the top wall, the bottom wall, the first sidewall, and the second sidewall includes an aperture with a contiguous and complete border that defines the aperture and completely encloses the aperture in a plane.

Example 16b. The drink container of example 15b comprising an additional pouch, wherein the pouch and the additional pouch are coupled to each other via a tether that traverses the aperture.

Example 17b. The drink container according to example 2b comprising a first transparent window in one of the first or second opposing side panels.

Example 18b. The drink container according to example 2b, wherein: a second end of the straw is opposite the first end of the straw; the first location is between the first and second ends of the straw; the second end of the straw is not fixedly attached to the interior surface and is free to move with the first point being a pivot point about which the second end of the straw pivots.

Example 19b. The drink container according to example 2b comprising an additional seam, wherein: the additional seam is connected to the border of the pouch; the additional seam contacts at least one of the first or second side panels; the additional seam has a seam tensile strength that is less than a tensile strength of the first side panel; the additional seam is configured, based on the seam tensile strength, to fail and form an opening to the inner chamber; the opening to the inner chamber is larger than an opening at the first end of the straw.

Example 20b. The drink container according to example 2b, wherein the straw includes a wall and the wall thickness is at least 0.75 mm but less than 1.50 mm.

Example 1c. A drink container (1300) comprising: a pouch including an exterior surface and an interior surface, the interior surface defining an internal chamber (1301) that is completely sealed off from the exterior surface; a straw (1302) located entirely within the internal chamber; a seam (1303) connected to a border (1304) of the pouch, the seam partially separating a first portion (1305) of the internal chamber from a second portion (1306) of the internal chamber; wherein the straw is fixedly attached to the interior surface at a first location (1307, 1307'); wherein the pouch includes first and second opposing side panels, the first and second opposing side panels coupled to one another along the border and along the seam; wherein the first side panel includes first and second layers; wherein a first portion (1308) of the first side panel includes the first layer but not the second layer; wherein the first portion of the internal chamber includes: (a) the first portion of the first side panel, and (b) a first end (1309) of the straw.

In an embodiment, the pouch may include 3 or more layers, one of which may include nylon. While Example 1c addresses first and second layers, this does not preclude a third layer, fourth layer, and the like.

Example 2c. The drink container of example 1c comprising a seal (1310) that couples to the seam, the seal coupling the first and second opposing side panels to one another.

Example 3c. The drink container according to any of examples 1c to 2c, wherein the first portion of the first side panel is ovular.

Example 4c. The drink container according to any of examples 1c to 3c, wherein the straw traverses the seal at a second location (1307').

Example 5c. The drink container of example 4c, wherein the straw is not fixedly attached to the interior surface at the second location.

In an embodiment, the straw is not heat sealed to the pouch at all. In such an embodiment the straw is held in place at location by 1310 alone and/or with a secondary pouch heat seal that is used to pin the straw against the side wall of the pouch as shown by location 44 FIG. 4A.

Example 6c. The drink container according to any of examples 1c to 3c, wherein the straw traverses the seal at the first location (1307').

In an embodiment, the straw is sealed to the package only at point 1307' and not at 1307. The straw/package seal extends a little below the seal of 1310, but the straw/package seal is focused at 1307'. However, the heat seal may extend below 1307' and all the way to 1307 or near 1307. The straw may be heated sealed to the pouch at point 1307'. Additionally, the pouch may be heat-sealed to itself in a line surrounding the straw as shown by 1310.

Example 7c. The drink contains according to any of examples 1c to 6c, wherein: the straw is fused to the interior surface at the first location; in response to the straw being fused to the interior surface at the first location, the straw is prohibited from rotation about a long axis of the straw and is further prohibited from translation along the long axis of the straw.

Example 8c. The drink container according to any of examples 1c to 7c, wherein the first portion of the internal chamber is fluidly coupled to the second portion of the internal chamber via the straw.

Example 9c. The drink container according to any of examples 1c to 8c, wherein the first portion of the internal chamber includes a fluid and the second portion of the internal chamber includes the fluid.

Example 10c. The drink container according to any of examples 1c to 9c, wherein the straw is fixedly attached to the interior surface at the first location via a heat seal.

Example 11c. The drink container according to any of examples 1c to 10c, wherein: the seam includes a middle portion, first side portion, and a second side portion; the middle portion is proportioned to fail while both (a) the first side portion continues to couple the first and second opposing side panels to one another, and (b) the second side portion continues to couple the first and second opposing side panels to one another.

Example 12c. The drink container according to any of examples 1c to 11c, wherein the first location is a pivot point of the straw.

Example 13c. The drink container of example 12c comprising a pathway for fluid to communicate between the first and second portions of the internal chamber, wherein the pathway is outside the straw and directly adjacent the straw at the second location.

Example 14c. The drink container according to any of examples 1c to 13c, wherein: a second end (1309') of the straw is opposite the first end of the straw; the internal chamber includes a border; the border of the internal chamber includes an arcuate portion (1311); the arcuate portion is immediately adjacent the second end of the straw.

Example 15c. The drink container according to any of examples 1c-14c, wherein: the pouch includes a top wall (1312) that interfaces the seam, a bottom wall (1313) opposite the top wall, a first sidewall (1314) that couples the bottom and top walls to each other, and a second sidewall (1315) that couples the bottom and top walls to each other; at least one of the top wall, the bottom wall, the first sidewall, and the second sidewall includes an aperture (1316) with a contiguous and complete border that defines the aperture and completely encloses the aperture in a plane.

Example 16c. The drink container of example 15c comprising an additional pouch, wherein the pouch and the additional pouch are coupled to each other via a tether that traverses the aperture.

Example 17c. The drink container according to any of examples 1c to 16c comprising a first transparent window in one of the first or second opposing side panels.

Example 18c. The drink container according to any of examples 1c to 17c, wherein: a second end (1309') of the straw is opposite the first end of the straw; the first location is between the first and second ends of the straw; the second end of the straw is not fixedly attached to the interior surface and is free to move with the first point being a pivot point about which the second end of the straw pivots.

Example 19c. The drink container according to any of examples 1c to 18c comprising an additional seam (1317), wherein: the additional seam is connected to the border of the pouch; the additional seam contacts at least one of the first or second side panels; the additional seam has a seam tensile strength that is less than a tensile strength of the first side panel; the additional seam is configured, based on the seam tensile strength, to fail and form an opening to the inner chamber; the opening to the inner chamber is larger than an opening at the first end of the straw.

Example 20c. The drink container according to any of examples 1c to 19c, wherein the straw includes a wall and the wall thickness is at least 0.75 mm but less than 1.50 mm.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A drink container comprising:

a pouch including an exterior surface and an interior surface, the interior surface defining an internal chamber that is completely sealed off from the exterior surface;

a straw located entirely within the internal chamber;

a seam connected to a border of the pouch, the seam partially separating a first portion of the internal chamber from a second portion of the internal chamber;

wherein the straw is fixedly attached to the interior surface at a first location;

wherein the pouch includes first and second opposing side panels, the first and second opposing side panels coupled to one another along the border and along the seam;

wherein the first side panel includes first and second layers;

wherein a first portion of the first side panel includes the first layer but not the second layer;

wherein the first portion of the internal chamber includes: (a) the first portion of the first side panel, and (b) a first end of the straw.

2. The drink container of claim 1 comprising a seal that couples to the seam, the seal coupling the first and second opposing side panels to one another.

3. The drink container according to claim 2, wherein the first portion of the first side panel is ovular.

4. The drink container according to claim 2, wherein the straw traverses the seal at a second location.

5. The drink container of claim 4, wherein the straw is not fixedly attached to the interior surface at the second location.

6. The drink container according to claim 2, wherein the straw traverses the seal at the first location.

7. The drink container according to claim 2, wherein:

the straw is fused to the interior surface at the first location;

in response to the straw being fused to the interior surface at the first location, the straw is prohibited from rotation about a long axis of the straw and is further prohibited from translation along the long axis of the straw.

8. The drink container according to claim 7, wherein the first portion of the internal chamber is fluidly coupled to the second portion of the internal chamber via the straw.

9. The drink container according to claim 8, wherein the first portion of the internal chamber includes a fluid and the second portion of the internal chamber includes the fluid.

10. The drink container according to claim 2, wherein the straw is fixedly attached to the interior surface at the first location via a heat seal.

11. The drink container according to claim 2, wherein:

the seam includes a middle portion, first side portion, and a second side portion;

the middle portion is proportioned to fail while both (a) the first side portion continues to couple the first and second opposing side panels to one another, and (b) the second side portion continues to couple the first and second opposing side panels to one another.

12. The drink container according to claim 2, wherein the first location is a pivot point of the straw.

13. The drink container of claim 12 comprising a pathway for fluid to communicate between the first and second portions of the internal chamber, wherein the pathway is outside the straw and directly adjacent the straw at a second location.

14. The drink container according to claim 2, wherein:

a second end of the straw is opposite the first end of the straw;

the internal chamber includes a border;

the border of the internal chamber includes an arcuate portion;

the arcuate portion is immediately adjacent the second end of the straw.

15. The drink container according to claim 2, wherein:

the pouch includes a top wall that interfaces the seam, a bottom wall opposite the top wall, a first sidewall that couples the bottom and top walls to each other, and a second sidewall that couples the bottom and top walls to each other;

at least one of the top wall, the bottom wall, the first sidewall, and the second sidewall includes an aperture with a contiguous and complete border that defines the aperture and completely encloses the aperture in a plane.

16. The drink container of claim 15 comprising an additional pouch, wherein the pouch and the additional pouch are coupled to each other via a tether that traverses the aperture.

17. The drink container according to claim 2 comprising a first transparent window in one of the first or second opposing side panels.

18. The drink container according to claim 2, wherein:

a second end of the straw is opposite the first end of the straw;

the first location is between the first and second ends of the straw;

the second end of the straw is not fixedly attached to the interior surface and is free to move with the first location being a pivot point about which the second end of the straw pivots.

19. The drink container according to claim 2 comprising an additional seam, wherein:

the additional seam is connected to the border of the pouch;

the additional seam contacts at least one of the first or second side panels;

the additional seam has a seam tensile strength that is less than a tensile strength of the first side panel;

the additional seam is configured, based on the seam tensile strength, to fail and form an opening to the internal chamber;

the opening to the internal chamber is larger than an opening at the first end of the straw.

20. The drink container according to claim 2, wherein the straw includes a wall having a thickness that is at least 0.75 mm but less than 1.50 mm.

* * * * *